United States Patent [19]

D'Agostino

[11] 4,125,886

[45] Nov. 14, 1978

[54] PROTECTIVE INSTALLATION

[76] Inventor: Alfred D'Agostino, 13 Allee des Marronniers, 95120 Ermont, France

[21] Appl. No.: 809,613

[22] Filed: Jun. 24, 1977

[30] Foreign Application Priority Data

Jun. 28, 1976 [FR] France ..... 76 19566

[51] Int. Cl.[2] ..... H01H 47/04

[52] U.S. Cl. ..... 361/139; 222/402.14; 239/71; 361/194

[58] Field of Search ..... 239/71; 222/70, 76, 222/402.14, 504; 307/10 R; 361/139, 194

[56] References Cited

U.S. PATENT DOCUMENTS

| | | | |
|---|---|---|---|
| 3,627,176 | 12/1971 | Sailors | 222/504 |
| 3,761,730 | 9/1973 | Wright | 361/194 |
| 3,843,056 | 10/1974 | Nye | 239/71 |
| 3,854,695 | 12/1974 | Baugh | 361/194 |
| 4,068,780 | 1/1978 | Fegley | 222/402.14 |

*Primary Examiner*—Gerald Goldberg

[57] ABSTRACT

A non-lethal protective system includes a defensive weapon, for example a gas canister, which may be rendered operative by means of actuating a remotely located electrical switch. Operation of the defensive weapon is effected by a solenoid which is controlled by a circuit including a pair of interlock switches which arm a main control switch.

4 Claims, 2 Drawing Figures

PROTECTIVE INSTALLATION

BACKGROUND OF THE INVENTION (1) Field of the Invention

The present invention relates to the protection of property, such as chests, safes and cupboards. More specifically, this invention is directed to defensive devices which are particularly adaptable to taxicabs and the like so as to enable the drivers to defend themselves in the event of attack. Accordingly, the general objects of the present invention are to provide novel and improved methods and apparatus of such character.

(2) Description of the Prior Art

While not limited thereto in its utility, the present invention is particularly well suited for installation in confined spaces such as, for example, taxicabs. There has long been a desire for a safe and non-lethal manner by which operators of for hire vehicles can protect themselves and their receipts from robbery.

SUMMARY OF THE INVENTION

An object of the invention is to provide a protective technique and installation which is simple, inexpensive and reliable in operation.

The installation according to the invention comprises a housing equipped with means for receiving an aerosol bottle which contains a gas, such as tear gas, and which is provided with a main control switch for the spraying of gas. The control switch supervises the energization of an electromagnet with a plunger-type core; the core being arranged to operate the push-button of the aerosol bottle carried by the housing when the electromagnet is energized. A typical installation also includes an electric supply circuit for the electromagnet. The supply circuit includes a pair of further interlock switches and a holding circuit for the electromagnet. In this way, a simple installation is provided, which can be easily adapted for use in a vehicle or any property to be protected, such as a chest or safe.

Preferably, the main control switch is push-button operated and has two contacts capable of being connected by a movable blade against the action of resilient means tending to space it from the contacts.

In accordance with one embodiment, the present invention includes a control box or casing carrying the first interlock switch, a supply circuit for a first pilot lamp operated by the first interlock switch, and a second interlock switch with a supply circuit for a second pilot lamp; the circuit of the main control switch and the holding circuit of the electromagnet being connected to the second interlock switch and the first interlock switch controlling the supply to the second interlock switch. Consequently, an installation is obtained which offers great security, since it is possible to check, firstly, if it is capable of functioning by closing the first interlock switch, and, secondly, if it can be brought into operation, by closing the second interlock switch, the effective control only being achieved by actuating the main control switch with both interlock switches being in the closed condition.

BRIEF DESCRIPTION OF THE DRAWING

The invention will be more readily understood by way of example from the following description of one embodiment thereof, reference being made to the accompanying drawings wherein like reference numerals refer to like elements in the two FIGURES and in which.

DESCRIPTION OF THE PREFERRED EMBODIMENT

Figure 1:
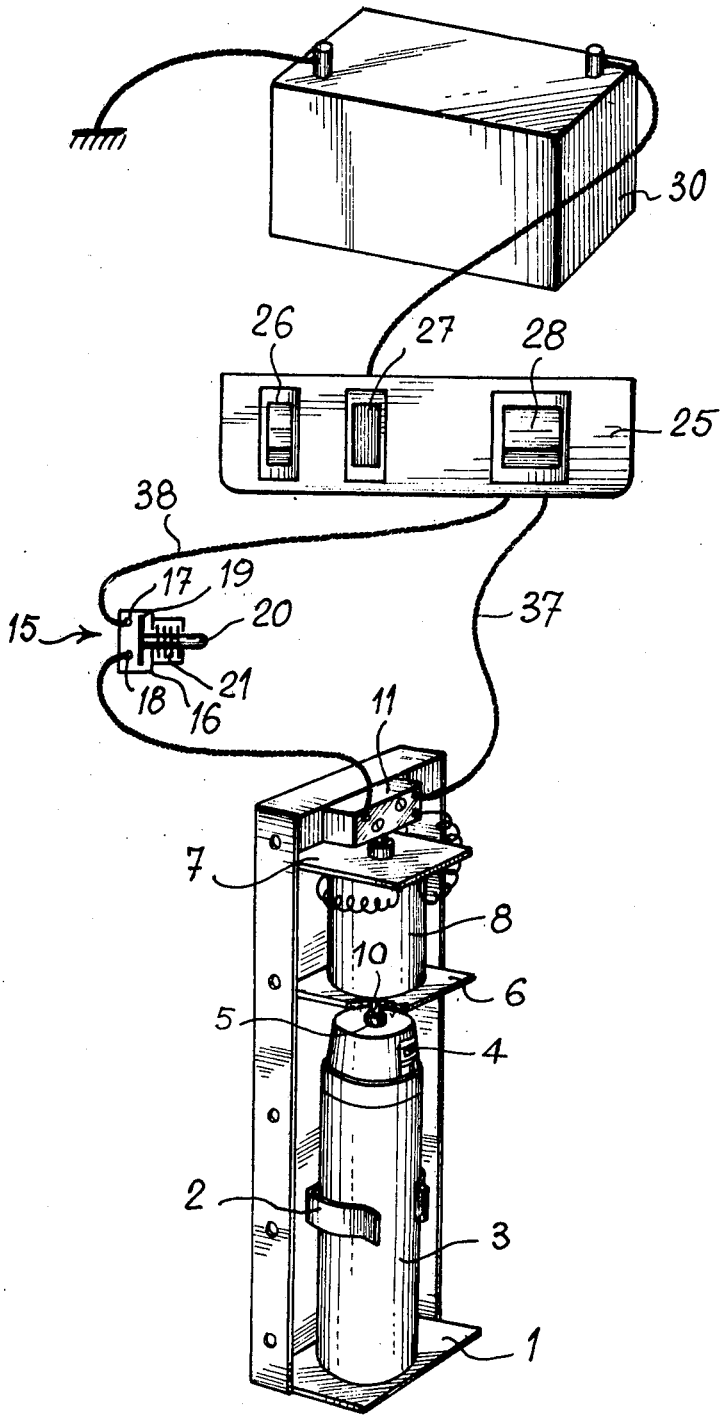
FIG. 1 is a perspective view of a protective installation in accordance with a preferred embodiment of the invention.

The installation which is to be described is one suitable for fitting in a vehicle, such as a taxicab, but quite obviously the installation can equally be used for protecting other property, such as chests, safes and cupboards.

The installation comprises a fitting or housing which includes a supporting plate 1 and a clip 2 designed to hold a pressurized gas bottle or canister 3. The bottle 3 is preferably an aerosol bomb of tear gas and comprises, in its upper part, a spraying nozzle 4 which is normally closed by a valve, the opening of the valve in bottle 3 is controlled by a pushbutton type actuator 5.

The housing further includes a pair of small platforms 6 and 7. An electromagnet 8 with a plunger-type core is mounted between platforms 6 and 7. The plunger of electromagnet 8 has an extension rod 10 which is designed to cooperate with the bottle nozzle actuator 5. Finally, the housing carries a box 11 which contains a relay with a holding circuit and appropriate circuit terminals. When the protective installation is to be carried by a taxicab or hire vehicle, the housing is adapted to be fixed along a door upright between the front and rear seats, being concealed by a cover having an opening opposite the spray nozzle 4, so that when pressure is applied to the push-button 5, the contained gas is able to escape to the exterior of the cover.

The installation includes a switch, indicated generally at 15, of the type formed by a casing 16 and having two fixed contacts 17 and 18, and a moving contact blade 19. Blade 19 is carried by a push-button 20 and normally held spaced from the contacts 17, 18 by a spring 21. When pressure is applied to the push-button 20, the circuit is closed against the action of the spring 21 by means of the contacts 17 and 18 being connected through the blade 19; the circuit being opened again as soon as the pressure on the push-button 20 is relaxed.

Finally, the installation is completed by a control box 25 which, in the case where the installation is installed in a vehicle, is fixed to the dashboard of that vehicle. The switch 15 is typically installed on the floor close to the clutch pedal.

The control box 25 contains a first main switch 26, a pilot device 27 and a second switch 28. Pilot device 27 is connected in the circuit of switch 26 and comprises, for example, a pilot lamp disposed behind a green window. The operating member of switch 28 is, for example, translucent and colored red and includes a pilot lamp. The control box 25 is connected to a suitable electric current source as, for example, an accumulator battery 30.

In the case of a hire vehicle provided with a taximeter, the control box 25 may be directly connected to the current supply of the taximeter so that, when the taximeter is not connected in the circuit, the installation cannot be set in operation.

Figure 2:
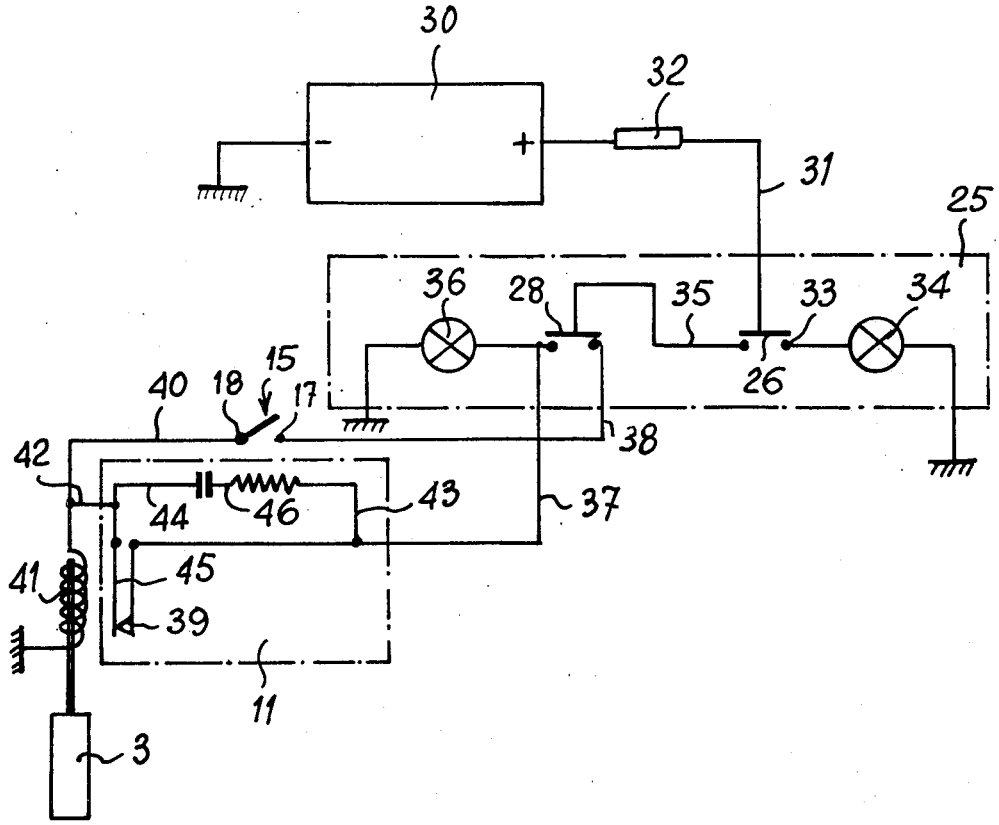
FIG. 2 is an electrical circuit diagram of the embodiment of FIG. 1.

The electric circuit of the installation is illustrated in FIG. 2. As there shown, the switch 26 is directly connected to the battery 30 by a lead 31, which includes a safety fuse 32. Switch 26, when closed, completes the current supply circuit of a pilot lamp 34 of the pilot device 27 having the green window. Closing of switch 26 also establishes a current path between battery 30 and switch 28 via a lead 35.

The circuit of switch 28 includes its pilot lamp 36, and two leads 37 and 38. Lead 38 is connected to the contact 17 of switch 15, while the lead 37 is connected to one of the contacts 39 of a relay in the box 11. Contact 18 of switch 15 is connected by a lead 40 to the solenoid 41 of the electromagnet 8, the return being via the common or ground circuit. A second contact 45 of the relay is connected to lead 40 by lead 42 and is also connected by a lead 44 to a circuit including capacitor 46. The circuit including capacitor 46 is connected to lead 37 by lead 43.

The above-described preferred embodiment operates as follows:

When switch 26 is closed, the pilot lamp 34 is energized and the installation is thus prepared for operation. Functioning of the installation can however only occur after switch 28 is also closed. This represents a safety arrangement avoiding improper operation.

When the switch 28 is closed, lamp 36 is supplied with current, but electromagnet 8 remains deenergized since the switch 15 is open and the contacts 39, 45 of the relay are also open.

If pressure is applied to the push-button 20 of the switch 15, the winding of the relay is energized so that contacts 39, 45 close and complete a holding circuit for the solenoid 41 via the lead 37, the contacts 39 and 45 and the lead 42.

With this arrangement, a simple pressure on the push-button 20 is sufficient to initiate the spraying of gas, which continues when push-button 20 is released and switch 15 reopened.

If the installation is fitted in a hire vehicle, the driver, when he is picking up a passenger, operates the switch 26 so as to confirm, via lamp 34, that the installation is receiving power. If, while he is driving, the driver senses a strangeness in the manner in which his passenger is behaving, he will operate the switch 28. The red pilot lamp 36 will thus be energized thereby informing and reminding the driver that a simple action on the push-button 20 of the switch 15 will set the system in operation.

The installation may also be fitted for protecting a chest or cupboard, the switch 15 being disposed in such a way that the opening of the door of the chest or cupboard closes the circuit, the support housing with the electromagnet, gas bottle, etc., being for example fitted inside the cupboard.

While preferred embodiments have been shown and described, various modifications and substitutions may be made thereto without departing from the spirit and scope of the invention. Accordingly, it is to be understood that the present invention has been described by way of illustration and not limitation.

What is claimed is:

1. Apparatus for the protection of property comprising:

a housing, said housing being adapted to receive a pressurized gas container provided with a normally closed push-button type valve for controlling release of gas;

an electromagnet with a plunger-type core, said core being positioned to operate the gas container valve when the electromagnet is energized;

an electric supply circuit for the electromagnet, said supply circuit being adapted to be connected to an electric current source and including arming switch means and, control switch means, said supply circuit further including a holding circuit for said electromagnet, the closure of said arming switch means applying an operating potential to said control switch means and the closing of said control switch means energizing said electromagnet and said holding circuit.

2. The apparatus of claim 1 wherein said control switch means includes a switch having two contacts capable of being connected by a movable blade against the action of resilient means tending to space the blade from the contacts and connected to a push-button.

3. The apparatus of claim 1 wherein said supply circuit further comprises:

a first interlock switch;

a first pilot lamp operated by said first switch;

a second interlock switch; and a second pilot lamp operated by said second switch, said control switch means and said holding circuit being connected to said second switch, said first switch controlling the supply of current to said second switch.

4. The apparatus of claim 2 wherein said supply circuit further comprises;

a first interlock switch;

a first pilot lamp operated by said first switch;

a second interlock switch; and a second pilot lamp operated by said second switch, said control switch means and said holding circuit being connected to said second switch, said first switch controlling the supply of current to said second switch.

* * * * *